United States Patent [19]

Kotake et al.

[11] 4,264,463

[45] Apr. 28, 1981

[54] PROCESS FOR REMOVING CALCIUM OXALATE SCALE

[75] Inventors: Masayoshi Kotake; Toshiki Mori; Kazuhiko Hayakawa, all of Funabashi, Japan

[73] Assignee: Nissan Chemical Industries Ltd., Tokyo, Japan

[21] Appl. No.: 969,867

[22] Filed: Dec. 15, 1978

[30] Foreign Application Priority Data

Dec. 27, 1977 [JP] Japan ..... 52-156384
Mar. 22, 1978 [JP] Japan ..... 53-32529

[51] Int. Cl.[3] ..... C23F 14/02; C11D 7/10; C11D 7/26

[52] U.S. Cl. ..... 252/87; 134/42; 252/80; 252/82

[58] Field of Search ..... 134/2, 42; 210/59; 252/82, 86, 87, 181, DIG. 11

[56] References Cited

U.S. PATENT DOCUMENTS

| | | | |
|---|---|---|---|
| 2,774,694 | 12/1956 | Wiggins | 134/13 |
| 3,338,828 | 8/1967 | Clark | 210/52 |
| 3,369,935 | 2/1968 | Booth et al. | 134/3 |
| 3,449,164 | 6/1969 | Vinkler et al. | 134/3 |
| 3,463,730 | 8/1969 | Booth et al. | 210/58 |
| 3,518,204 | 6/1970 | Hansen et al. | 252/181 |
| 3,655,552 | 4/1972 | Flock et al. | 210/47 |
| 3,684,720 | 8/1972 | Richardson | 252/86 |
| 3,706,669 | 12/1972 | Gardner | 252/82 |
| 3,753,924 | 8/1973 | Franiau | 252/389 R |
| 3,793,209 | 2/1974 | Thompson | 252/87 |
| 3,794,523 | 2/1974 | Thompson | 134/3 |
| 3,801,501 | 4/1974 | Kennedy | 210/59 |
| 4,108,680 | 8/1978 | Barr | 134/3 |

FOREIGN PATENT DOCUMENTS

| | | | |
|---|---|---|---|
| 842602 | 6/1939 | France | 252/80 |
| 1005312 | 4/1952 | France | 252/181 |

OTHER PUBLICATIONS

Elliot et al., "Calcium Oxalate Solubility: Effect of Trace Metals," Investigative Urology, vol. 4, No. 5, pp. 428–430.

*Primary Examiner*—P. E. Willis, Jr.
*Attorney, Agent, or Firm*—Oblon, Fisher, Spivak, McClelland & Maier

[57] ABSTRACT

A scale containing calcium oxalate as a main component which is adhered on an inner wall of an apparatus is easily removed by contacting it with an aqueous solution containing (1) aluminum ions and/or ferric ions and (2) anions of acid.

23 Claims, No Drawings

PROCESS FOR REMOVING CALCIUM OXALATE SCALE

BACKGROUND OF THE INVENTION

The present invention relates to a process for removing a scale containing calcium oxalate adhered on an inner wall of an apparatus.

Scales adhered on an inner wall of an apparatus used in various processes are made of calcium oxalate as a main component.

These scales have not easily dissolved by the conventional methods, since the scale containing calcium oxalate as a main component (hereinafter referred to as a scale of calcium oxalate) is not easily dissolved in a strong acid or a strong base.

Such scales are mainly formed on an inner wall of an evaporator for concentrating a waste solution discharged from a digester (black liquor) in a sulfite pulp process, a chemiground pulp process or a semichemical pulp process. Such scales are also formed on an inner wall of an apparatus for producing a cane sugar or a beet sugar. Such scales are further formed on an inner wall of an apparatus for producing beer, whisky or wine. Such scales are also formed on an inner wall of a bleaching tower for bleaching a pulp.

SUMMARY OF THE INVENTION

It is an object of the present invention to provide a process for removing a scale of calcium oxalate which is formed on an inner wall of an apparatus used in a sulfite pulp process, a chemiground pulp process, semichemical pulp process, a cane sugar or beet sugar manufacturing process, a beer fermentation process, a wine fermentation process or a whisky distillation process or a pulp bleaching process.

The foregoing and other objects of the present invention have been attained by contacting a scale of calcium oxalate with an aqueous solution containing (1) aluminum ions and/or ferric ions and (2) anions of acid such as hydrochloric acid, nitric acid, sulfamic acid, formic acid, acetic acid, propionic acid, oxalic acid, glycolic acid, malonic acid, malic acid, lactic acid, tartaric acid and citric acid.

DETAILED DESCRIPTION OF THE PREFERRED EMBODIMENTS

The efficiency for removing a scale of calcium oxalate is mainly depending upon a velocity for dissolving calcium oxalate component combined with other components in a scale, regardless of a solubility of calcium oxalate itself.

The aqueous solutions used in the present invention should contain (1) aluminum ions and/or ferric ions and (2) anions of an inorganic or organic acid. The other components can be incorporated as far as the purpose of the present invention is attained.

Suitable anions of the inorganic or organic acid include chloride ions, nitrate ions, sulfamate ions, formate ions, acetate ions, propionate ions, oxalate ions, glycolate ions, malonate ions, malate ions, lactate ions, tartrate ions, and citrate ions.

The aqeuous solution used in the present invention can be easily prepared by incorporating compounds for forming aluminum ions, ferric ions and the anions of an inorganic or organic acid in water.

For example, a water soluble compound having an acid radical of an inorganic or organic acid and a compound having aluminum component or iron component are used.

The aqueous solutions can be prepared by reacting the compound having aluminum component or iron component such as aluminum hydroxide, metallic aluminum powder, iron hydroxide or metallic iron powder with an acid such as hydrochloric acid, nitric acid, sulfamic acid, formic acid, acetic acid, glycolic acid, oxalic acid, malonic acid, malic acid, lactic acid, tartaric acid, and citric acid in water.

The aqueous solutions can be also prepared by dissolving an aluminum or ferric normal salt, acidic salt or basic salt of said acid in water.

The aqueous solutions can be also prepared by dissolving said aluminum or ferric salt and said acid or a salt of said acid in water.

It is preferable to use an aqueous solution which does not contain a material causing an environmental pollution and a precipitate in the solution by contacting with a scale of calcium oxalate and which does not corrode an inner wall of an apparatus.

The aqueous solution used in the present invention preferably contains about 0.1 to 40 wt.% especially 1.0 to 15 wt.% of aluminum ions, ferric ions and the anions of acid. An equation ratio of (1) aluminum ions and/or ferric ions to (2) anions of acid is usually 3:2.5 to 6.0.

The chemical structure of the scale of calcium oxalate is varied depending upon the formation of the scale. The scale is dissolved in high efficiency by contacting 10 to 1000 wt. parts of the aqueous solution containing (1) aluminum ions and/or ferric ions and (2) the anions of acid with 1 wt. part of the scale.

In order to remove the scale in high efficiency for a short time, it is preferable to maintain the temperature of the aqueous solution at higher level. However, the inner wall of the apparatus is corroded at high temperature. Accordingly, the temperature of the aqueous solution is usually at 20° to 90° C. preferably 30° to 70° C. especially 50° to 70° C.

In the process for removing a scale of calcium oxalate, a formation of a precipitate in the aqueous solution can be easily prevented by using an aqueous solution containing the anions of acid which do not form a precipitate. The anions of acid which easily form a precipitate are sulfate ions and phosphate ions which form calcium sulfate and calcium phosphate.

It is especially advantageous to use sulfamate ions or anions of organic acid because a corrosion of an inner wall of an apparatus can be reduced.

In accordance with the process of the present invention, a scale of calcium oxalate can be dissolved in only several tens times of 5% aqueous solution containing aluminum ions and sulfamate ions. This is unthinkable effect.

In the process of the present invention, a scale of calcium oxalate can be removed and the operation can be simply performed without any trouble.

The process for dissolving and removing a scale containing calcium oxalate as a main component which is referred to as a scale of calcium oxalate will be further illustrated.

Typical scales of calcium oxalate are as follows.

(1) Scale adhered on an inner wall of an evaporator for concentrating a black liquor of a waste solution discharged from a digester in a sulfite pulp process, a chemiground pulp process or a semichemical pulp process.

(2) Scales adhered on inner walls of apparatuses contacting with a squeezed or extracted sugar syrup, a clarified sugar syrup or a concentrated sugar syrup in steps of producing a crude molasses from the squeezed or extracted syrup in sugar industry. Scale adhered on an inner wall of an apparatus contacting molasses in a step of producing refined molasses from the crude molasses.

These scales are adhered on inner walls of a heater pipes and a filter for the squeezed or extracted syrup and pipes and an evaporator for concentration for the clarified syrup, pipes for the concentrated syrup and a crystallizer.

(3) Scale adhered on an inner wall of a fermentation vessel for a beer fermentation of mart.

(4) Scale adhered on an inner wall of a fermentation vessel for a fermentation of mart to prepare whisky or a distiller for a distillation of a fermented culture.

(5) Scale adhered on an inner wall of a fermentation vessel for a fermentation of a grape juice to prepare wine.

(6) Scale adhered on an inner wall of a bleaching tower for bleaching a pulp, especially a kraft pulp in a multi-bleaching steps, such as five steps of a chlorination step, an alkali extraction step, a hypochlorite bleaching step, chlorine dioxide bleaching step and a peroxide bleaching step, especially in the hypochlorite bleaching step.

When a scale is adhered on an inner wall of an evaporator, a heat conductivity is reduced whereby it is important to remove the scale.

When a scale is adhered on an inner wall of a fermentation vessel, a heat conductivity is reduced and a product is contaminated.

When a scale is adhered on an inner wall of a pipe or a filter, a flow of a solution is interrupted.

When a scale containing calcium oxalate as a main component is adhered, the scale can not be removed by using a rinsing water or a detergent and also can not be easily removed by using a strong acid such as hydrochloric acid, nitric acid or sulfuric acid or a strong base such as sodium hydroxide or potassium hydroxide, moreover, a substrate of the vessel or a pipe is easily corroded by the strong acid or the strong base.

Accordingly, a mechanical removement by peeling off the scale has been employed.

As an efficient method of removing the scale by a mechanical method, a high pressurized water having 200 to 350 atm. is injected from a nozzle at a high flow velocity such as 10 tons/hour to the scale thereby peeling off the scale. However, this method requires a high pressurizing device, a pressure resistant device, labors and large energy, moreover, the scale adhered on a curved part or a fine corner can not be easily removed. Further more, the high velocity water is injected fresh surface of the wall whereby certain abrasion of the substrate of the vessel is caused and it is further necessary to disassemble and to assemble the apparatus for injecting the pressurized water.

It has been known to remove a scale by a two step dissolution process wherein a hot aqueous solution of NaOH or $Na_2CO_3$ is contacted with the scale and then the aqueous solution of the base is substituted with an aqueous solution of sulfamic acid to contact with the scale.

In this method, it is necessary to contact the aqueous solution of the base for a long time, and otherwise the effect for removing the scale in the second step is negligible. Accordingly, this method is not suitable for practical operation.

In the process of the present invention, the scale of calcium oxalate can be easily dissolved and removed.

For example, an inner wall of an evaporator for concentrating a black liquor is made of steel or stainless steel of SS-41, SUS-304 or STB-35. The scale contains calcium component and oxalate component at a ratio of about 40 to 80 wt.% and other components of water and inorganic and organic components to form a hard structure. The scale is firmly adhered on the inner wall of the vessel.

When a thickness of the scale reaches to about several mm, the heat conductivity is remarkably reduced and the removement of the scale is required.

The scale can be easily dissolved and removed by contacting with the aqueous solution containing (1) aluminum ions and/or ferric ions and (2) anions of acid because the scale becomes fragile.

As it is well known, when a large portion of a scale is dissolved, the scale is easily peeled off from an inner wall of an apparatus. Accordingly, the dissolution of scales of calcium oxalte is tested in various manners.

EXAMPLE 1

Aluminum hydroxide and sulfamic acid at a molar ratio of 1:3 were dissolved in water to prepare 10% aqueous solution of aluminum sulfamate.

A brown scale having a thickness of about 1 mm which was adhered on an inner wall of an evaporator for concentrating black liquor in a chemigroundwood pulp plant was peeled off and cut into a size of about 5 mm×10 mm.

In a beaker, 100 g of 10% aqueous solution of aluminum sulfamate was charged and heated at 70° C. and 2.5 g of the scale was charged and they were stirred at 70° C. for 4 hours and the dissolution was observed during the stirring. The solution gradually was colored depending upon the dissolution of the scale and the scale was completely dissolved for about 120 minutes and no precipitate was formed.

In accordance with the same manner except incorporating 0.6% of a commercial anticorrosive agent in 10% aqueous solution of aluminum sulfamate, the dissolution of the scale was observed. The result was similar to said result.

The scale used in the process of Example 1 was analyzed to find 25.3 wt.% of calcium component as Ca, 52.4% of oxalic acid component as $C_2O_4$, and small amounts of the other components of water, inorganic and organic components.

EXAMPLE 2

In accordance with the process of Example 1 except using a commercial aluminum nitrate with or without incorporating the commercial anti-corrosive agent, the dissolution of the scale was observed.

In both cases, the scale was dissolved for about 130 minutes and no precipitate was found in the resulting solution.

EXAMPLE 3

In accordance with the process of Example 1 except using a mixture of the aqueous solution of aluminum sulfamate and the aqueous solution of aluminum nitrate at a volumetric ratio of 1:1, insted of the aqueous solution of aluminum sulfamate, the dissolution of the scale was observed. The scale was dissolved for about 123 minutes.

EXAMPLES 4 TO 7

In accordance with the process of Example 1 except using each aqueous solution having the formula of Table 1 prepared by using 10% aqueous solution of aluminum chloride, 10% aqueous solution of aluminum sulfamate and 10% aqueous solution of aluminum nitrate, the dissolutions of the scale were observed. The results are shown in Table 1.

When the aqueous solution of aluminum chloride (Example 4), the aqueous solution of aluminum chloride and aluminum nitrate (Example 5) or the aqueous solution of aluminum chloride and aluminum sulfamate (Example 6) and the aqueous solution of aluminum chloride, aluminum nitrate and aluminum sulfamate (Example 7) were used, the dissolutions of the scale were excellent and the precipitate was not formed in every cases.

TABLE 1

| Example | Composition of aqueous solution (wt. %) | | | Dissolution time (min.) |
|---|---|---|---|---|
| | $AlCl_3$ | $Al(NO_3)_3$ | $Al(NH_2SO_3)_3$ | |
| 4 | 10 | — | — | 110 |
| 5 | 5 | 5 | — | 120 |
| 6 | 5 | — | 5 | 120 |
| 7 | 3.3 | 3.3 | 3.3 | 120 |

Four kinds of aqueous solutions shown in Table 2 were prepared as follows.

(1) 15% aqueous solution of aluminum sulfamate prepared by dissolving aluminum hydroxide and sulfamic acid at a molar ratio of 1:3 in water.

(2) 15% aqueous solution of aluminum chloride prepared by dissolving aluminum chloride in water.

(3) 15% aqueous solution of aluminum nitrate prepared by dissolving aluminum nitrate in water.

(4) A mixture of said aqueous solutions (1), (2) and (3) in which 0.6% of an anticorrosive agent was dissolved.

Corrosion tests of these aqueous solutions to each test piece were carried out.

Test piece A: SS-41. (abrasive processing in Japanese Industrial Standard G 3101, #320) a size: 1 mm×24 mm×75 mm. The test piece was treated by degreasing with acetone.

Test piece B: SUS 304 (abrasive processing in Japanese Industrial Standard G 4305, #320). The size and the degreasing treatment are the same with those of Test piece A.

Four test pieces A and four test pieces B were leaned in each of eight 200 ml glass vessels.

In each vessel, 180 g of each of the aqueous solutions (1), (2), (3) and (4) was charged to dip the test pieces and it was kept at 60° C. for 6 hours in stand still and the treated test pieces were taken out and rinsed with water stream.

Four test pieces A were dipped in 10% aqueous solution of diammonium citrate for 1 minute at 70° C. and then, they were taken out and washed with water stream.

Four test pieces B were not dipped in the aqueous solution of diammonium citrate. Both of the test pieces A, B were rinsed with aceton and dried and weighed to measure each reduced weight. The results are shown in Table 2.

TABLE 2

| Aqueous solution | Concentration of aq. sol. (wt. %) - | | | Anti-corrosive agent | Reduced weight in corrosion(mg./cm²/hr.) | |
|---|---|---|---|---|---|---|
| | $AlCl_3$ | $Al(NO_3)_3$ | $Al(NH_2SO_3)_3$ | | Test piece A | Test piece B |
| (3) | — | 15 | — | 0.6 | 0.154 | 0.002 |
| (1) | — | — | 15 | 0.6 | 0.083 | 0.008 |
| (2) | 15 | — | — | 0.6 | 0.051 | 0.013 |
| (4) | 5 | 5 | 5 | 0.6 | 0.116 | 0.020 |

It was confirmed that these aqueous solutions of the invention had significantly low corrosive property and can be used in practical applications.

EXAMPLE 8

Two kinds of scales (A) and (B) adhered on an inner wall of an evaporator for sugar syrup in a cane sugar plant were dried at 105° C. for 2 hours and analyzed. The results are shown in Table 3.

It was further found to contain minor components of Na, Fe, Mg, $SO_4$, $PO_4$ and organic materials.

TABLE 3

| Kind of scale | $CaC_2O_4 \cdot H_2O$ (wt. %) | $CaCO_3$ (wt. %) | Other (wt. %) | $CaC_2O_4 \cdot H_2O$ by X ray diffraction |
|---|---|---|---|---|
| A | 59.5 | 11.4 | 29.1 | detected |
| B | 84.1 | 10.7 | 5.2 | detected |

Each of 2.5 g the scale (A) and scale (B) was charged in each 200 ml beaker. In each beaker, 100 g of 10% aqueous solution of the aluminum salt shown in Table 4 was charged and the mixture was stirred at 60° C. for 2 hours and the insoluble materials were measured to obtain each dissolution percent. The results are shown in Table 4. As the reference, 10% aqueous solution of sulfamic acid was used and the dissolution percent was also determined. The results are shown in Table 4.

TABLE 4

| Experiment No. | Aqueous solution of solute | Dissolution percent of scale (%) | |
|---|---|---|---|
| | | A | B |
| 1 | $AlCl_3$ | 80.1 | 87.5 |
| 2 | $Al(NO_3)_3$ | 85.6 | 90.0 |
| 3 | $Al(NH_2SO_3)_3$ | 79.2 | 83.5 |
| 4 | $Al(HCOO)_3$ | 35.7 | 38.0 |
| 5 | $Al(HOCH_2COO)_3$ | 32.3 | 32.8 |
| 6 | $NH_2SO_3H$ | 23.0 | 22.2 |

The aqueous solution of sulfamic acid had low scale dissolving function, however, the aqueous solutions containing aluminum ions and anions of acid had high scale dissolving function.

The insoluble materials were further treated under the same condition.

In the cases of Experiments No. 1 to 3, the insoluble materials were dissolved in the second treatment. In the cases of Experiments No. 4 and 5, the insoluble materials were dissolved in the third treatment.

Corrosion tests of these aqueous solutions shown in Table 4 to steel, stainless steel and copper test pieces A, B and C were carried out.

The tests were carried out by the following method.

Test piece A: SS-41 (abrasive processing in Japanese Industrial Standard G 3101 #320) size: 1 mm×12 mm×75 mm.

Test piece B: SUS 304 (abrasive processing in Japanese Industrial Standard G 4305 #320) size: 1 mm×12 mm×75 mm.

Test piece C: Copper (abrasive processing in Japanese Industrial Standard H. 3100 (C 1100P) #320) size: 1 mm×12 mm×75 mm.

In each 100 ml glass vessel, 90 g of each of the aqueous solutions of Experiments No. 1 to 6 was charged and 0.5% of an anticorrosive agent was added to the aqueous solution and dissolved it.

The test pieces A, B and C which were degreased by washing with acetone were separately dipped in the aqueous solution, and they were kept at 60° C. for 6 hours in stand-still.

The test pieces were taken up and rinsed with water stream.

The test pieces B and C were further rinsed with acetone and dried. The test pieces A were further dipped in 10% aqueous solution of diammonium citrate at 70° C. for 1 minute and further rinsed with water stream and rinsed with acetone and dried and weighed to determine reduced weights in corrosion. The results are shown in Table 5.

It was confirmed that the aqueous solutions of the aluminum salts had low corrosive property and can be used in practical applications.

TABLE 5

| Aqueous solution | Reduced weight in corrosion ($mg/cm^2/hr.$) | | |
|---|---|---|---|
| | Test piece A | Test piece B | Test piece C |
| $AlCl_3$ | 0.0310 | 0.0017 | 0.0051 |
| $Al(NO_3)_3$ | 0.0105 | 0.0004 | 0.0228 |
| $Al(NH_2SO_3)_3$ | 0.0013 | 0.0010 | 0.0034 |
| $Al(HCOO)_3$ | 0.0015 | 0.0007 | 0.0001 |
| $Al(HOCH_2COO)_3$ | 0.0022 | 0.0005 | 0.0034 |
| $NH_2SO_3H$ | 0.0225 | 0.0015 | 0.0025 |

EXAMPLE 9

In a beaker, 100 g of 10% aqueous solution of ferric sulfamate was charged and kept at 60° C. A brown scale having a size of 5×10×1 mm adhered on an inner wall of an evaporator for concentrating black liquor in a chemiground pulp factory was sampled and 2.5 g of the scale was charged in the beaker and the mixture was stirred whereby the scale was completely dissolved for about 120 minutes. The scale was analyzed to find 86.9% of calcium oxalate and 13.1% of the other components.

EXAMPLE 10

Two kinds of scales (A) and (B) adhered on an inner wall of an evaporator for sugar syrup in a cane sugar plant were dried at 105° C. for 2 hours and analyzed. The results are shown in Table 3.

Each of 2.5 g of the scale (A) and scale (B) was charged in each 200 ml beaker. In the beaker for the scale (A), 100 g of 10% aqueous solution of the ferric nitrate was charged. In the beaker for the scale (B), 100 g of 10% aqueous solution of ferric chloride was charged. The mixture was heated at 60° C. and stirred. As the results, the scale (A) was completely dissolved after 60 minutes and the scale (B) was completely dissolved after about 90 minutes.

EXAMPLE 11

Aqueous solutions having the solutes shown in Table 6 were prepared by incorporating sulfamic acid in the aqueous solutions of aluminum sulfamate, aluminum nitrate or aluminum chloride prepared by the processes of Example, 1, 2 or 4.

In accordance with the process of Example 1 except using a scale having the following composition and the resulting aqueous solutions, the dissolutions of the scale were observed. The results are shown in Table 6. The composition of the scale is as follows.

Calcium oxalate ($CaC_2O_4.H_2O$), 62.3%
Calcium carbonate ($CaCO_3$), 7.7%
Calcium sulfite ($CaSO_3.\frac{1}{2}H_2O$), 27.5%

TABLE 6

| Composition of solute in aq. sol.(wt. %) | Aqueous solution No. | | | | | | |
|---|---|---|---|---|---|---|---|
| | 1 | 2 | 3 | 4 | 5 | 6 | 7 |
| $AlCl_3$ | 7 | — | — | 10 | — | — | — |
| $Al(NO_3)_3$ | — | 7 | — | — | 10 | — | — |
| $Al(NH_2SO_3)_3$ | — | — | 7 | — | — | 10 | — |
| $NH_2SO_3H$ | 3 | 3 | 3 | — | — | — | 10 |
| Dissolution of scale percent (%) | 100 | 100 | 100 | 100 | 100 | 100 | 75 |
| time for dissolving (min.) | 90 | 90 | 90 | 120 | 120 | 120 | 240 |

EXAMPLE 12

10% Aqueous solutions of organic acids as shown in Table 7 were prepared by dissolving various organic acids in water.

10% Aqueous solutions of aluminum salts of organic acids as shown in Table 7 were prepared by reacting aluminum hydroxide with an organic acid in water.

In each beaker, 2.5 g of a scale adhered on an inner wall of an evaporator for concentrating a waste solution discharged from a digester in a soda-base sulfite pulp process, and each of the aqueous solutions of organic acids or aluminum salts was charged and the mixtures were stirred at 60° C. for 4 hours and insoluble materials were measured and dissolution percents were determined. The results are shown in Table 7.

It was found that the aqueous solutions of aluminum salts had high functions for dissolving the scale.

The composition of the scale is as follows.

Calcium oxalate ($CaC_2O_4.H_2O$), 85.3%
Calcium sulfite ($CaSO_3$), 8%
other inorganic materials, 6.7%

TABLE 7

| Experiment No. | Solute in aqueous solution | Dissolution percent (%) |
|---|---|---|
| 1 | formic acid | 11.2 |
| 2 | acetic acid | 8.5 |
| 3 | glycolic acid | 12.0 |
| 4 | citric acid | 13.1 |
| 5 | aluminum formate | 46.8 |
| 6 | aluminum acetate | 31.6 |
| 7 | aluminum glycolate | 38.0 |
| 8 | aluminum citrate | 49.5 |

What is claimed is:

1. A process for removing a scale containing calcium oxalate as a main component which comprises contacting said scale with an aqueous solution containing an effective amount, for the removal of a scale containing calcium oxalate as a main component, of (1) ions selected from the group consisting of aluminum ions, ferric ions and mixtures thereof and (2) anions of acid selected from the group consisting of nitric acid, sulfamic acid, formic acid, acetic acid, propionic acid, glycolic acid, malonic acid, malic acid, lactic acid, tartaric acid, citric acid and mixtures thereof.

2. The process according to claim 1, wherein the aqueous solution contains aluminum ions and anions of acid selected from the group consisting of sulfamic acid, formic acid, acetic acid glycolic acid, citric acid and mixtures thereof.

3. The process according to claim 2 wherein the aqueous solution contains (1) aluminum ions and (2) said anions of acid at a equation ratio of 3 to 2.5 to 6.0.

4. The process according to claim 3 wherein the aqueous solution contains 0.1 to 40 wt.% of aluminum ions and said anions of acid.

5. The process according to claim 4 wherein 10 to 1000 wt. parts of said aqueous solution is contacted with 1 wt. part of said scale at 20° to 90° C.

6. The process according to claim 2, wherein said aqueous solution is prepared by reacting aluminum hydroxide or metallic aluminum with said acid in water.

7. The process according to claim 2, wherein the aqueous solution is prepared by dissolving aluminum salt of said acid in water.

8. The process according to claim 1 or 5 wherein said scale is formed on an inner wall of an evaporator for concentrating a waste solution discharged from a digester in a preparation of pulp by a process selected from the group consisting of a chemiground process, a semichemical process and a sulfite process.

9. The process according to claim 1 or 5 wherein said scale is formed on an inner wall of an apparatus which contacts with a material selected from the group consisting of strained syrup, extracted syrup, a syrup admixed with lime, a filtrate thereof, a concentrated filtrate thereof and a sugar crystallization mother liquor wherein said apparatus is used in a process for producing sugar selected from the group consisting of cane sugar and beet sugar.

10. The process according to claim 7 further comprising adding sulfamic acid to the resulting aqueous solution of aluminum salt of said acid.

11. The process according to claim 6, wherein said scale is formed on an inner wall of an evaporator for concentrating a waste solution discharged from a digester in a preparation of pulp by a process selected from the group consisting of a chemiground process, a semichemical process and a sulfite process.

12. The process according to claim 7, wherein said scale is formed on an inner wall of an evaporator for concentrating a waste solution discharged from a digester in a preparation of pulp by a process selected from the group consisting of a chemiground process, a semichemical process and a sulfite process.

13. The process according to claim 6, wherein said scale is formed on an inner wall of an apparatus which contacts with a material selected from the group consisting of strained syrup, extracted syrup, a syrup admixed with lime, a filtrate thereof, a concentrated filtrate thereof and a sugar crystallization mother liquor wherein said apparatus is used in a process for producing sugar selected from the group consisting of cane sugar and beet sugar.

14. The process according to claim 7, wherein said scale is formed on an inner wall of an apparatus which contacts with a material selected from the group consisting of strained syrup, extracted syrup, a syrup admixed with lime, a filtrate thereof, a concentrated filtrate thereof and a sugar crystallization mother liquor wherein said apparatus is used in a process for producing sugar selected from the group consisting of cane sugar and beet sugar.

15. The process according to claim 1 or 5 wherein said scale is formed on an inner wall of a fermentation vessel for a beer fermentation of mart.

16. The process according to claim 1 or 5 wherein said scale is formed on an inner wall of a fermentation vessel for a fermentation of mart to prepare whiskey.

17. The process according to claims 1 or 5 wherein scale is formed on an inner wall of a distillation apparatus for the distillation of a fermented culture.

18. The process according to claim 6, wherein said scale is formed on an inner wall of a fermentation vessel for a beer fermentation of mart.

19. The process according to claim 6, wherein said scale is formed on an inner wall of a fermentation vessel for a fermentation of mart to prepare whiskey.

20. The process according to claim 6, wherein said scale is formed on an inner wall of a distillation apparatus for the distillation of a fermented culture.

21. The process according to claim 7, wherein said scale is formed on an inner wall of a fermentation vessel for a beer fermentation of mart.

22. The process according to claim 7, wherein said scale is formed on an inner wall of a fermentation vessel for a fermentation of mart to prepare whiskey.

23. The process according to claim 7, wherein said scale is formed on an inner wall of a distillation apparatus for the distillation of a fermented culture.

* * * * *